US011925218B1

(12) United States Patent
Xu et al.

(10) Patent No.: US 11,925,218 B1
(45) Date of Patent: Mar. 12, 2024

(54) THIGH-CONSTRICTING AND HIP-LIFTING PANTS

(71) Applicant: POPILUSH LLC, Williamsburg, VA (US)

(72) Inventors: Zhennan Xu, Fujian (CN); Huijuan Lin, Fujian (CN)

( * ) Notice: Subject to any disclaimer, the term of this patent is extended or adjusted under 35 U.S.C. 154(b) by 0 days.

(21) Appl. No.: 18/473,967

(22) Filed: Sep. 25, 2023

(30) Foreign Application Priority Data

Jul. 24, 2023 (CN) ..... 202321948360.5

(51) Int. Cl.
*A41B 11/14* (2006.01)
*A41D 1/06* (2006.01)

(52) U.S. Cl.
CPC ..... *A41D 1/06* (2013.01); *A41D 2400/38* (2013.01)

(58) Field of Classification Search
CPC ..... A41D 1/06; A41D 2400/38; A41D 1/21; A41B 9/04
See application file for complete search history.

(56) References Cited

U.S. PATENT DOCUMENTS 3,590,823 A * 7/1971 Pope, Jr. ..... A41F 11/18 450/95
4,019,208 A * 4/1977 Walser, Jr. ..... A41B 11/143 2/409
6,023,789 A * 2/2000 Wilson ..... A41D 1/089 2/404
6,704,942 B2 * 3/2004 Lazarian ..... A41B 11/14 2/409
9,427,029 B2 * 8/2016 Castellano ..... A41B 17/00
10,806,190 B1 * 10/2020 Kardashian West ... A41C 1/003
2018/0263299 A1 * 9/2018 Padin ..... A41C 1/003
2020/0260805 A1 * 8/2020 Ovington ..... A41D 17/02
2021/0169156 A1 * 6/2021 Murphy ..... A41B 9/08
2022/0264968 A1 * 8/2022 Bentz ..... A41D 1/06

FOREIGN PATENT DOCUMENTS

CN 215649324 U 1/2022
WO WO-2017177285 A1 * 10/2017 ..... A41D 1/08

* cited by examiner

*Primary Examiner* — Tajash D Patel

(57) ABSTRACT

The present utility model relates to the technical field of body-shaping clothes, and in particular to thigh-constricting and hip-lifting body-shaping pants. The thigh-constricting and hip-lifting body-shaping pants include a pants body, wherein the pants body has a second shaping portion on a back side of the pants body and a first shaping portion on a front side of the pants body; the first shaping portion is arranged corresponding to upper thighs and a pubis region and has two inner side edges extending to inner thighs and two outer side edges extending to outer thighs; and the second shaping portion is arranged corresponding to positions below hips, and both ends of the second shaping portion and the corresponding outer side edges of the first shaping portion are connected at the outer thighs, respectively.

10 Claims, 10 Drawing Sheets

THIGH-CONSTRICTING AND HIP-LIFTING PANTS

BACKGROUND OF THE INVENTION

1. Technical Field

The present utility model relates to the technical field of body-shaping clothes, and in particular to thigh-constricting and hip-lifting body-shaping pants.

2. Description of Related Art

In order to highlight feminine curves, the clothing industry has developed various types of shapewear, shaping pants or other products. A Chinese public patent document (CN215649324U) discloses novel abdomen-constricting and hip-lifting long pants, including a long pants body, rubber cushion pockets and rubber cushions, wherein the long pants body includes a front piece and a back piece; the front piece is provided with an abdomen-constricting band, which has an X form stitched and spliced from fabrics and corresponds to an abdomen of a wearer; and the back piece is provided with a hip-lifting band, which is located corresponding to bottom hips of the wear. The novel abdomen-constricting and hip-lifting long pants of this utility model better fit the wearer's body to improve a shaping effect. However, these long pants have the following defects: in one aspect, the constrictive band is visible from the appearance, and thus cannot meet the visual aesthetic requirements of users for the integral appearance of the outer body-shaping pants; and in another aspect, the effect of constricting the fat of the inner thighs cannot be while the hips are lifted.

BRIEF SUMMARY OF THE INVENTION

It is an object of the present utility model to provide thigh-constricting and hip-lifting body-shaping pants, in order to meet the visual requirement of the users for an integral appearance while achieving the effects of lifting the hips and constricting the fat of the inner thighs.

To achieve the object above, the present utility model employs a technical solution as follows:

thigh-constricting and hip-lifting body-shaping pants include a pants body, wherein the pants body has a second shaping portion on a back side of the pants body and a first shaping portion on a front side of the pants body; the first shaping portion is arranged corresponding to upper thighs and a pubis region and has two inner side edges extending to inner thighs and two outer side edges extending to outer thighs; the second shaping portion is arranged corresponding to positions below hips, and both ends of the second shaping portion and the corresponding outer side edges of the first shaping portion are connected at the outer thighs, respectively; a lowest point of each of the outer side edges of the first shaping portion is higher than a lowest point of each of the inner side edges of the first shaping portion; and the second shaping portion and the first shaping portion cooperate with each other to constrict muscles at the inner thighs and lift muscles of the hips.

Preferably, the pants body is a jumpsuit or bottom pants.

Preferably, the second shaping portion has a double-layer shaping fabric structure; the second shaping portion consists of a second surface layer of the pants body corresponding to the positions below the hips and an inner hip-lifting piece fixedly combined at an inner side of the second surface layer; the inner hip-lifting piece extends from a crotch of the pants body to the two outer thighs; and upper and lower side edges of the inner hip-lifting piece are both combined with corresponding positions of the second surface layer.

Preferably, the second shaping portion and adjacent sides of the pants body are seamlessly woven into a whole; and a stiffness coefficient of the second shaping portion is greater than a stiffness coefficient of an adjacent region.

Preferably, the first shaping portion has a double-layer body-shaping fabric structure; the first shaping portion consists of a first surface layer of the pants body corresponding to the upper thighs and the pubis region and an inner shaping piece fixedly combined at an inner side of the first surface layer.

Preferably, the thigh-constricting and hip-lifting body-shaping pants according to claim 5, wherein the pants body has outer side seams and inner side seams; the inner shaping piece is fixedly combined on the first surface layer along the outer side seams and the inner side seams; side boundaries of the inner shaping piece connected to the inner side seams are inner side edges of the inner shaping piece; side boundaries of the inner shaping piece connected to the outer side seams are outer side edges of the inner shaping piece; a lowest-point of each of the outer side edges of the inner shaping piece is higher than a lowest point of each of the inner side edges of the inner shaping piece; and the outer side edges of the inner shaping piece and the second shaping portion are connected at the outer side seams.

Preferably, a side boundary of the inner shaping piece between the lowest points of the inner side edges of the inner shaping piece and the lowest points of the outer side edges of the inner shaping piece is a hem of the inner shaping piece; the hem of the inner shaping piece is arranged inclinedly; and the hem of the inner shaping piece and the first surface layer are fixedly combined or have a free opening reserved therebetween.

Preferably, the inner shaping piece is of a single-piece integral construction or a double-piece parallel construction.

Preferably, the pants body further includes a third shaping portion having a double-layer body-shaping structure; the third shaping portion is arranged corresponding to an abdomen region below a chest; the third shaping portion includes an inner abdomen-constricting piece connected with the inner shaping piece into a whole; and left and right ends of the inner abdomen-constricting piece are fixedly combined at the outer side seams of the pants body, respectively.

Preferably, the pants body further includes a fourth shaping portion having a double-layer body-shaping fabric structure; the fourth shaping portion is arranged corresponding to back and rear waist regions; the fourth shaping portion includes a inner back-flattening piece; and left and right ends of the inner back-flattening piece are fixedly combined at the outer side seams of the pants body, respectively.

Compared with the prior art, the present utility model has the following beneficial effects.

According to the present utility model, the surface and inner layers of the pants body are provided with the second shaping portion corresponding to positions below the hips and the first shaping portion corresponding to the upper thighs and the pubis region, and the inner side edges of the first shaping portion extend to the inner thighs and the outer side edges of the first shaping portion are connected to both ends of the second shaping portion; the second shaping portion lifts upward the muscles of the hips to firm the hips and create a create an upwarped hip form, while dragging and stretching the first shaping portion to constrict fat on the inner thighs to achieve a constrictive effect; and the first shaping portion also drags and stretches the second shaping portion to enhance the hip-lifting effect, and in addition, the first shaping portion shows a shaping effect for the front sides of the upper thighs and the pubis region.

According to the present utility model, the first shaping portion has the hem designed to incline from outside to inside, and has the outer side edges connected to both ends of the second shaping portion, such that, compared with the hem design with aligned inner and outer edges, this design can reduce the wrinkles of the hem during walking and moving; and the hem is further designed with loose pieces that are openable freely, such that the apparent unaesthetic twists and wrinkles resulting from mutual dragging between the surface layer and the inner shaping piece can be further reduced during walking and moving, and meanwhile, the stitches at this spot are invisible from the appearance.

According to the present utility model, the first shaping portion preferably has the double-layer body-shaping fabric structure, and the inner shaping piece at the inner side is fixedly combined along the inner and outer side seams of the pants body, such that the concealed inner piece and the integrally aesthetic surface layer can be kept; and similarly, the concealed inner piece and the integrally aesthetic surface layer can also be kept for the inner abdomen-constricting piece and the inner back-flattening piece.

DETAILED DESCRIPTION OF THE INVENTION

In order to make the above features and advantages of the present utility model clearer and more understandable, embodiments are provided below in combination with the accompanying drawings to make explanations in details.

Embodiment 1

Figure 1:
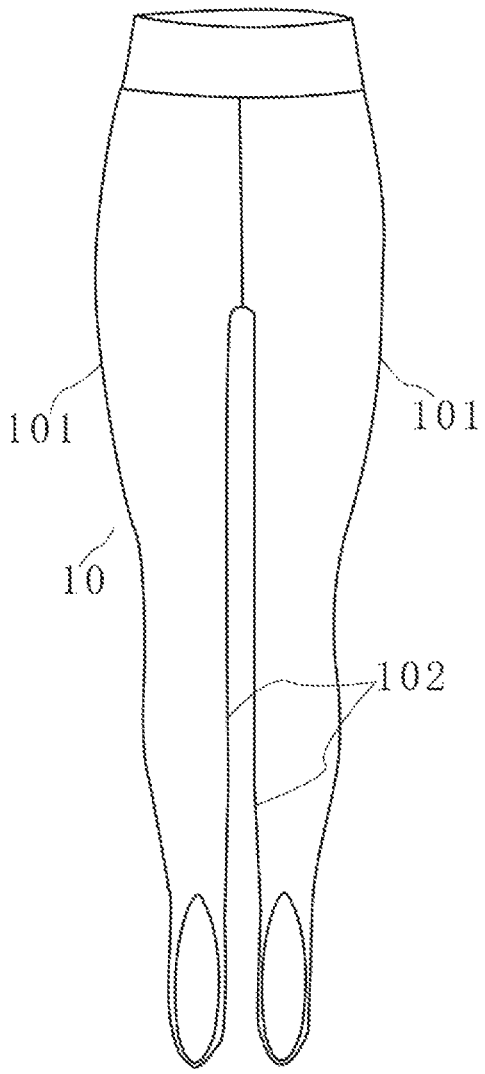
FIG. 1 shows an external front view of body-shaping pants according to Embodiments 1 to 3 of the present utility model.
Figure 2:
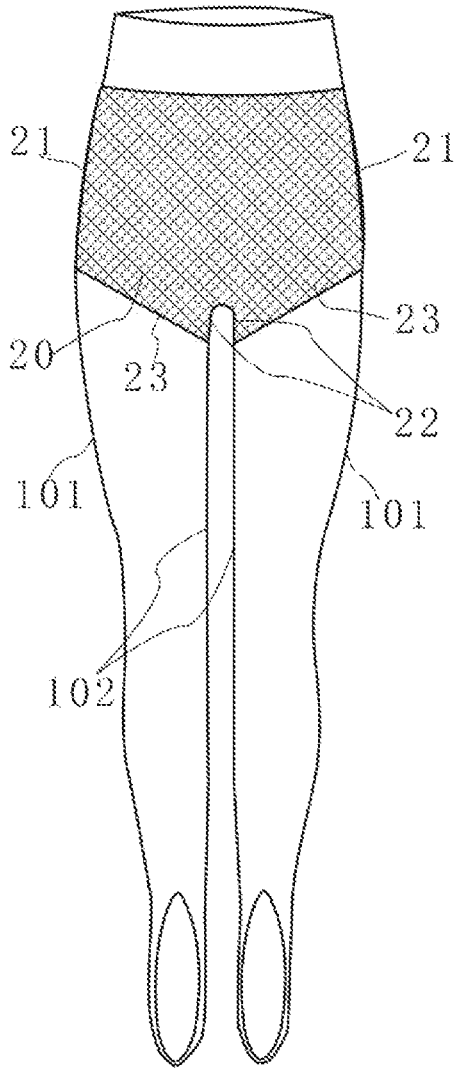
FIG. 2 shows a schematic diagram of a front structure of the body-shaping pants in a reversed side according to Embodiments 1 and 3 of the present utility model.
Figure 3:
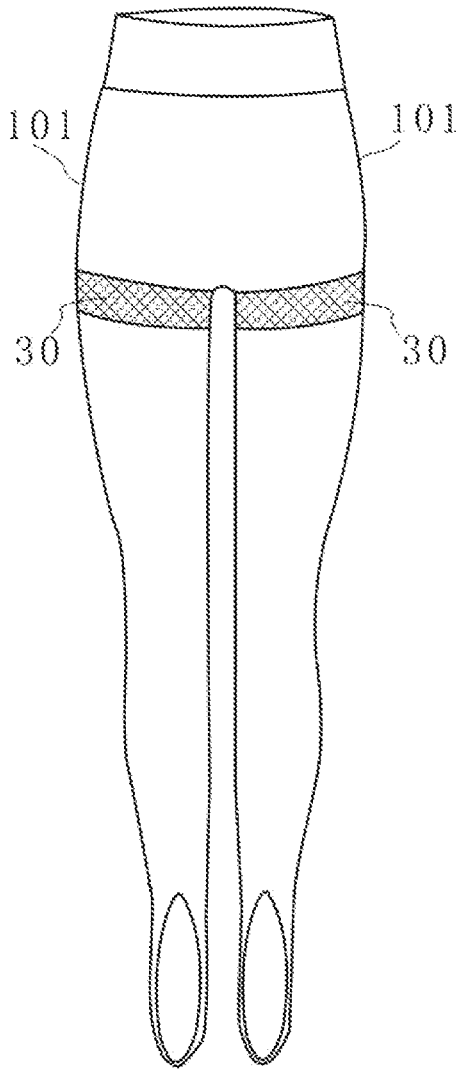
FIG. 3 shows a schematic diagram of a back structure of the body-shaping pants in a reversed side according to Embodiments 1 to 3 of the present utility model.

As shown in FIG. 1 to FIG. 3, this embodiment provides thigh-constricting and hip-lifting body-shaping pants, including a pants body of a bottom pants form, with an unlimited length. The pants body includes a body-shaping surface layer 10, an inner body-shaping piece 20, and an inner hip-lifting piece 30; the body-shaping surface layer 10, the inner body-shaping piece 20 and the inner hip-lifting piece 30 are all made of a body-shaping fabric; the inner body-shaping piece 20 and the inner hip-lifting piece 30 are both fixedly combined at an inner side of the body-shaping surface layer 10; the body-shaping surface layer 10 is formed into a bottom pants style by splicing a front pants piece and a back pants piece; and the front pants piece and the back pants piece form outer side seams 101 at two sides of a body and inner side seams 102 at inner thighs.

In this embodiment, the body-shaping surface layer 10 covers the lower part of the body below the waist and abdomen, and includes a first surface layer and a second surface layer; the correspondingly arranged first surface layer and inner body-shaping piece 20 are seamlessly woven to jointly form the first shaping portion having a double-layer body-shaping fabric structure; the first shaping portion is located at the front of the pants body and correspondingly covers the human upper thighs and pubis region; the second surface layer and the inner hip-lifting piece 30 are arranged correspondingly and jointly form the second shaping portion having a double-layer body-shaping fabric structure; and the second shaping portion is located at the back of the pants body and arranged corresponding to the positions below the human hips. The second shaping portion is arranged corresponding to positions below the hips, and both ends of the second shaping portion and the corresponding outer side edges of the first shaping portion are connected at the outer thighs, respectively; and the second shaping portion and the first shaping portion cooperate with each other to constrict the muscles at the inner thighs and lift the muscles of the hips.

The first shaping portion has two inner side edges extending to the inner thighs and two outer side edges extending to the outer thighs; and the lowest point of each of the outer side edges of the first shaping portion is higher than the lowest point of each of the inner side edges of the first shaping portion. Specifically in this embodiment, the inner body-shaping piece 20 is of a single-piece integral construction, and is fixedly combined on the first surface layer along the outer side seams 101 and the inner side seams 102; and the inner body-shaping piece 20 is fixedly combined with the outer side seams 101 and the inner side seams 102 preferably in a continuous stitching manner, or a fitting or intermittent stitching manner in other examples.

Side boundaries of the inner body-shaping piece 20 connected to the inner side seams 102 are inner side edges 22 of the inner body-shaping piece 20; side boundaries of the inner body-shaping piece 20 connected to the outer side seams 101 are outer side edges 21 of the inner body-shaping piece 20; a side boundary of the inner body-shaping piece 20 between the lowest points of the inner side edges 22 of the inner body-shaping piece 20 and the lowest points of the outer side edges of the inner body-shaping piece 20 is a hem 23 of the inner body-shaping piece 20; the lowest-point of each of the outer sides edges 21 of the inner body-shaping piece 20 is higher than the lowest point of each of the inner side edges 22 of the inner body-shaping piece 20, such that the hem 23 of the inner body-shaping piece 20 is inclinedly arranged; and a free opening is reserved between the hem 23 of the inner body-shaping piece 20 and the first surface layer. The free opening means that the hem 23 of the inner body-shaping piece 20 and the first surface layer are not fixedly combined. This free opening can reduce the apparent unaesthetic twists and wrinkles resulting from mutual dragging between the first surface layer and the inner body-shaping piece 20 during walking and moving, and meanwhile, the stitches here are thus invisible. In this embodiment, the hem 23 of the inner body-shaping piece 20 is a straight edge, which may also be a wavy edge in other examples.

However, in other examples, the hem 23 of the inner body-shaping piece 20 and the pants body surface layer may also be fixedly combined in a herringbone stitching manner. The top edge of the inner body-shaping piece 20 is preferably fixed to an upper end of the first surface layer by continuous stitching; and the upper end of the first surface layer corresponds to a waist of the pants.

In this embodiment, the inner hip-lifting piece 30 extends from a crotch of the pants body to the outer thighs; upper and lower side edges of the inner hip-lifting piece 30 are both combined with the second surface layer at corresponding positions; left and right side edges of the inner hip-lifting piece 30 are respectively combined with the outer side seams 101 of the pants body at corresponding sides; and the outer side edges 21 of the inner body-shaping piece 20 and the inner hip-lifting piece 30 are connected at the outer side seams 101.

When the inner hip-lifting piece 30 and the second surface layer are combined by continuous stitching or intermittent stitching, the inner hip-lifting piece 30 consists of a first inner hip-lifting piece and a second inner hip-lifting piece. The adjacent ends of the first inner hip-lifting piece and second inner hip-lifting piece are both stitched at the crotch of pants body and preferably along a lower crotch seam of the pants body; and the divergent ends of the first inner hip-lifting piece and second inner hip-lifting piece extend upward to the outer side seams 101 at the corresponding sides of the pants body.

When the inner hip-lifting piece 30 and the second surface layer are combined by fitting, the inner hip-lifting piece 30 is of an integral piece form, with a middle part located at the crotch and both ends extending upwards to the outer side seams 101 at the corresponding sides of the pants body.

Embodiment 2

Figure 4:
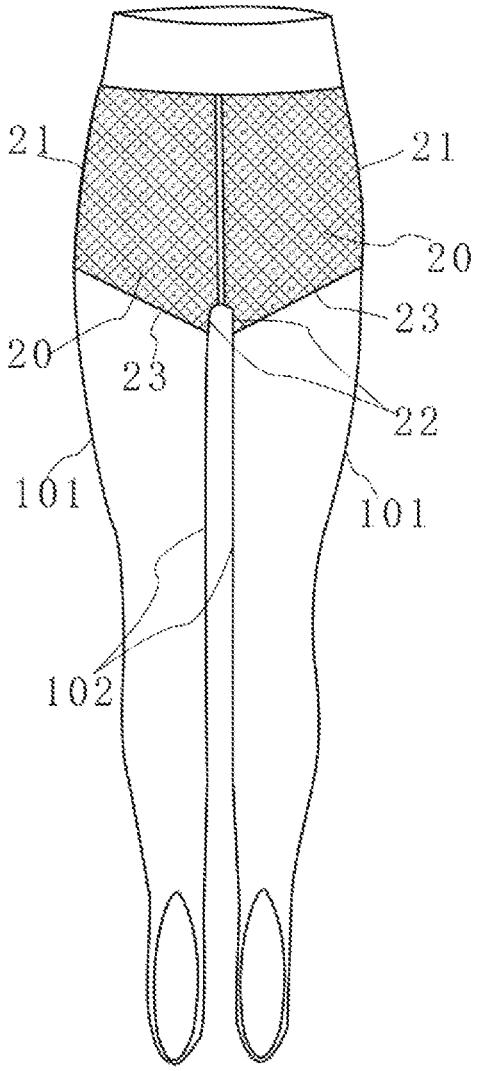
FIG. 4 shows a schematic diagram of a front structure of the body-shaping pants in a reversed side according to Embodiment 2 of the present utility model.

This embodiment differs from Embodiment 1 described above only in that: the inner shaping piece 20 is constructed into a double-piece parallel construction from a single-piece integral construction. In this embodiment, the inner shaping piece 20 consists of a first inner shaping piece and a second inner shaping piece. As shown in FIG. 4, the first inner shaping piece correspondingly covers the left upper thigh and left pubis region of a human body, and the second inner shaping piece correspondingly covers the right upper thigh and right pubis region of the human bod; the first inner shaping piece and the second inner shaping piece are connected at a front crotch seam of a body-shaping surface layer 10; the first inner shaping piece and the second inner shaping piece each have one inner side edge 22 extending to one inner thigh and an outer side edge 21 extending to the inner thigh; the outer side edge 21 of the first inner shaping piece and the outer side edge 21 of the second inner shaping piece are fixedly combined on a first surface layer along an outer side seam 101 of the pants body, respectively; and the inner side edge 22 of the first inner shaping piece and the inner side edge 22 of the second inner shaping piece are fixedly combined at the first surface layer along an inner side seam 102 of the pants body, respectively. The lowest point of the outer side edge 21 of the first inner shaping piece is higher than the lowest point of the inner side edge 22 of the first inner shaping piece, such that a hem 23 of the first inner shaping piece is arranged inclinedly; and a free opening is reserved between the hem 23 of the first inner shaping piece and the first surface layer. Similarly, a hem 23 of the second inner shaping piece is arranged inclinedly, and a free opening is reserved between the hem 23 of the second inner shaping piece and the first surface layer.

Embodiment 3

This embodiment differs from Embodiment 1 described above only in that: this embodiment does not have an inner hip-lifting piece. A second surface layer of the body-shaping surface layer 10 corresponding to positions below hips has a stiffness coefficient greater than that of an adjacent region of the body-shaping surface layer 10 adjacent to said second surface layer; this second surface layer and the adjacent region of the pants body are seamlessly woven into a whole; the second surface layer constitutes a second shaping portion and extends upward from a bottom crotch of the pants body to connect an outer side edge 21 of the inner shaping piece 20 at the outer side seam 101 of the pants body.

Embodiment 4

Figure 5:
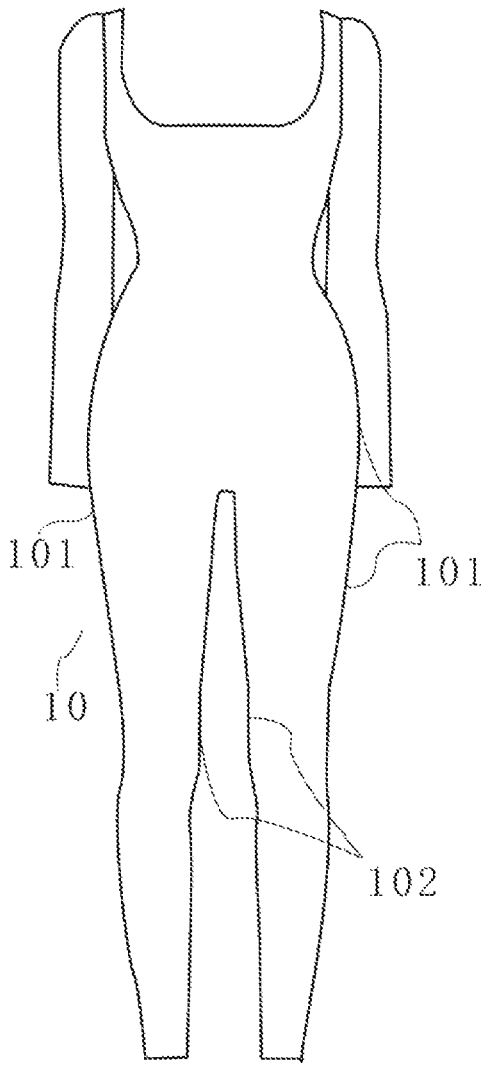
FIG. 5 shows an external front view of body-shaping pants according to Embodiment 4 of the present utility model.
Figure 6:
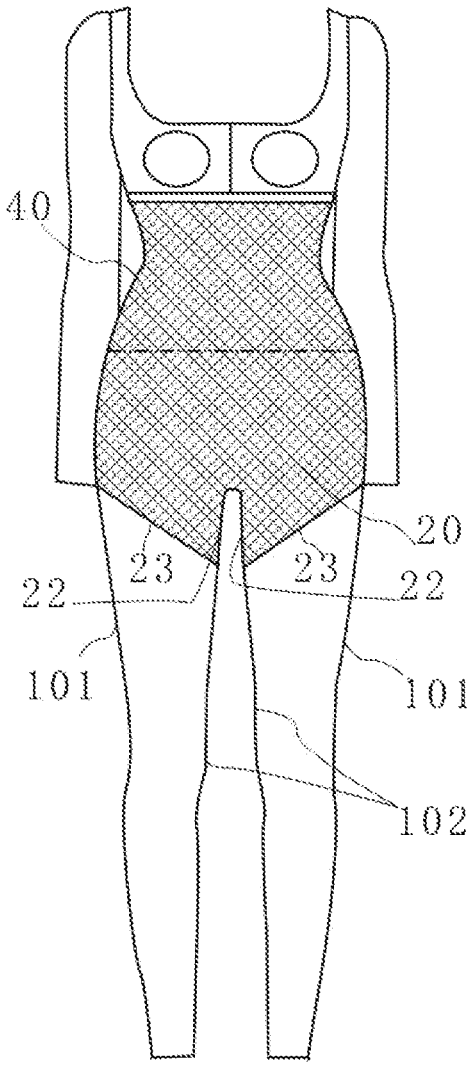
FIG. 6 shows a schematic diagram of a front structure of the body-shaping pants in a reversed side according to Embodiment 4 of the present utility model.
Figure 7:
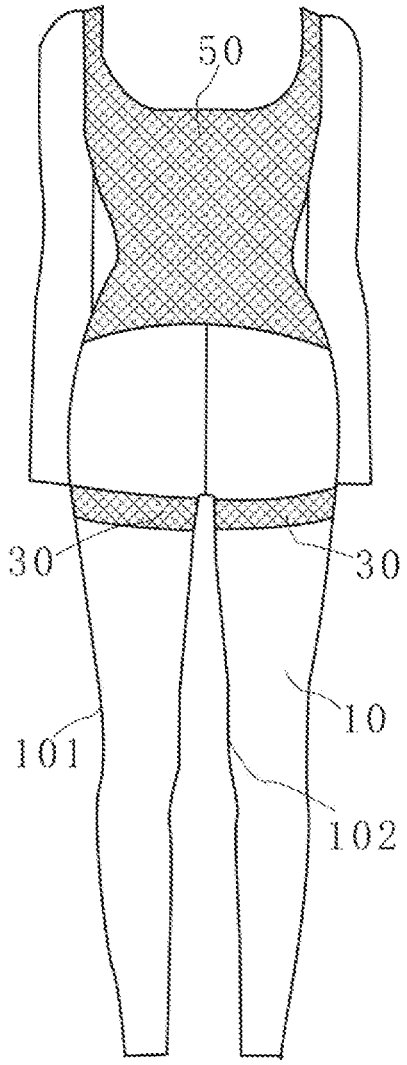
FIG. 7 shows a schematic diagram of a back structure of the body-shaping pants in a reversed side according to Embodiment 4 of the present utility model.

As shown in FIG. 5 to FIG. 7, this embodiment provides thigh-constricting and hip-lifting body-shaping pants, including a pants body of a jumpsuit form, with an unlimited length. The pants body includes a body-shaping surface layer 10, an inner body-shaping piece 20, an inner abdomen-constricting piece 40, an inner back-flattening piece 50, and an inner hip-lifting piece 30; the body-shaping surface layer 10, the inner body-shaping piece 20, the inner abdomen-constricting piece 40, the inner back-flattening piece 50, and the inner hip-lifting piece 30 are all made of a body-shaping fabric; and the inner body-shaping piece 20, the inner abdomen-constricting piece 40, the inner back-flattening piece 50, and the inner hip-lifting piece 30 are all fixedly combined at an inner side of the body-shaping surface layer 10. The body-shaping surface layer 10 is formed into a jumpsuit style by splicing a front pants piece and a back pants piece; the front pants piece and the back pants piece form outer side seams 101 at two sides of a body and inner side seams 102 at inner thighs; and the outer side seams 101 of the upper body portion of the jumpsuit and the outer side seams 101 of the lower body portion of the jumpsuit are connected into a whole.

In this embodiment, the body-shaping surface layer 10 covers an upper body and a lower body, and includes a first surface layer, a second surface layer, a third surface layer, and a fourth surface layer. The first surface layer and the third surface layer are seamlessly woven into a whole; and the second surface layer, the body-shaping surface layer corresponding to hips, and the fourth surface layer are seamlessly woven into a whole. Here, the first surface layer and the inner shaping piece 20 are correspondingly arranged and jointly form the first shaping portion of a double-layer body-shaping fabric structure, and the first shaping portion is located at a front side of the pants body and correspondingly covers a human upper thigh and pubis region. The second surface layer and the inner hip-lifting piece 30 are correspondingly arranged and jointly form the second shaping portion of a double-layer body-shaping fabric structure, and the second shaping portion is located at a back side of the pants body and arranged corresponding to positions below human hips. The third surface layer and the inner abdomen-constricting piece 40 are correspondingly arranged and jointly form a third shaping portion of a double-layer body-shaping fabric structure, and the third shaping portion is located at the front side of the pants body and correspondingly covers an abdomen region below the human chest. The fourth surface layer and the inner back-flattening piece 50 are correspondingly arranged and jointly form a fourth shaping portion of a double-layer body-shaping fabric structure, and the fourth shaping portion is located at the back side of the pants body and correspondingly covers the human back and rear waist region. In addition, the jumpsuit in this embodiment is provided with cup portions at positions corresponding to breasts, and pads are removably installed in the cup portions.

The first shaping portion has two inner side edges extending to the inner thighs and two outer side edges extending to the outer thighs; and the lowest point of each of the outer side edges of the first shaping portion is higher than the lowest point of each of the inner side edges of the first shaping portion. Specifically in this embodiment, the inner body-shaping piece 20 is of a single-piece integral construction, and is fixedly combined on the first surface layer along the outer side seams 101 and the inner side seams 102; and the inner body-shaping piece 20 is fixedly combined with the outer side seams 101 and the inner side seams 102 preferably in a continuous stitching manner, or a fitting or intermittent stitching manner in other examples.

Side boundaries of the inner body-shaping piece 20 connected to the inner side seams 102 are inner side edges 22 of the inner body-shaping piece 20; side boundaries of the inner body-shaping piece 20 connected to outer side seams 101 are outer side edges 21 of the inner body-shaping piece 20; a side boundary of the inner body-shaping piece between the lowest points of the inner side edges 22 of the inner body-shaping piece 20 and the lowest points of the outer side edges 21 of the inner body-shaping piece 20 is a hem 23 of the inner body-shaping piece 20; the lowest-point of each of the outer sides edges 21 of the inner body-shaping piece 20 is higher than the lowest point of each of the inner side edges 22 of the inner body-shaping piece 20, such that the hem 23 of the inner body-shaping piece 20 is inclinedly arranged; and a free opening is reserved between the hem 23 of the inner body-shaping piece 20 and the first surface layer. The free opening means that the hem 23 of the inner body-shaping piece 20 and the first surface layer are not fixedly combined. This free opening can reduce the apparent unaesthetic twists and wrinkles resulting from mutual dragging between the first surface layer and the inner body-shaping piece 20 during walking and moving, and meanwhile, the stitches here are thus invisible. However, in other examples, the hem 23 of the inner body-shaping piece 20 and the pants body surface layer may also be fixedly combined in a herringbone stitching manner.

In this embodiment, the hem 23 of the inner body-shaping piece 20 is a straight edge, which may also be a wavy edge in other examples.

In this embodiment, the inner abdomen-constricting piece 40 of the third shaping portion and the inner shaping piece 20 are connected into a whole; left and right ends of the inner abdomen-constricting piece 40 are fixedly combined on the third surface layer along the outer side seams 101 of the pants body, respectively; a top edge of the inner abdomen-constricting piece 40 is fixedly combined at an upper end of the third surface layer and located at a position below the chest; and the inner abdomen-constricting piece 40 and the third surface layer are fixedly combined preferably in a continuous stitching manner, or a fitting or intermittent stitching manner in other examples.

Figure 8:
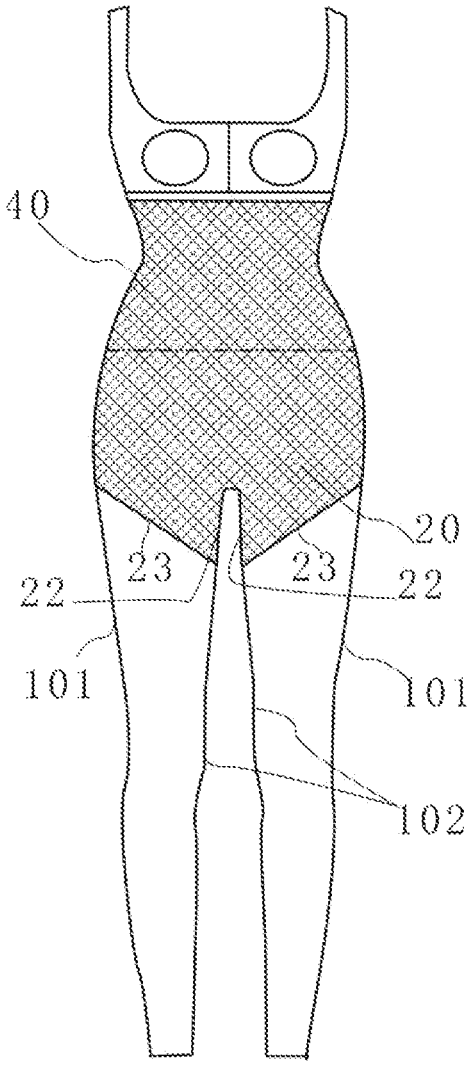
FIG. 8 shows a schematic diagram of a front structure of sleeveless body-shaping pants in a reversed side according to the present utility model.
Figure 9:
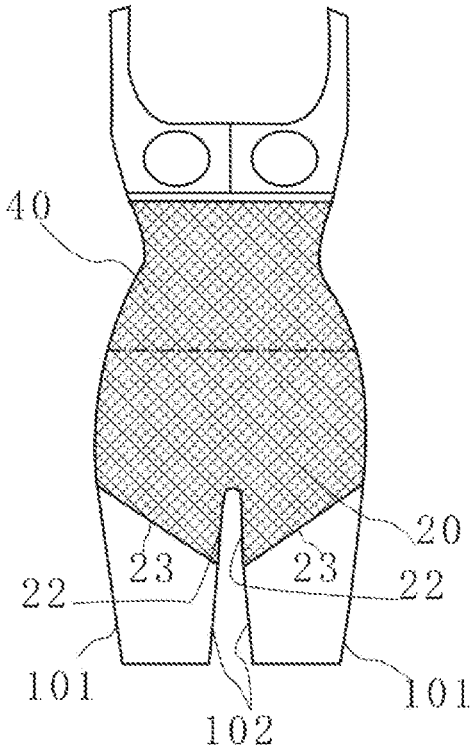
FIG. 9 shows a schematic diagram of a front structure of the sleeveless body-shaping shorts in a reversed side according to the present utility model.

In this embodiment, left and right ends of the inner back-flattening piece 50 of the fourth shaping portion are fixedly combined at the fourth surface layer along the outer side seams 101 of the pants body; a hem of the inner back-flattening piece 50 is correspondingly located on a human rear waistline; and a single-layer body-shaping surface layer is only provided between the inner back-flattening piece 50 and the inner hip-lifting piece 30. The single layer is kept provided on the hips to prevent the hips from being compressed by multiple layers, thereby providing more space for the fabric to extend. A free opening is reserved between the hem of the inner back-flattening piece 50 and the fourth surface layer; meanwhile, a portion of the fourth surface layer corresponding to the middle of the rear waist is fixedly combined with the inner back-flattening piece 50 to prevent the inner back-flattening piece from shifting; and a top edge of the inner back-flattening piece 50 is fixedly combined with a neckline and muffs of the pants body. Similarly, the inner back-flattening piece 50 and the body-shaping surface layer 10 are fixedly combined preferably in a stitching manner. In this embodiment, the body-shaping pants are provided with sleeves and long pants, or may be sleeveless (as shown in FIG. 8) or shorts (as shown in FIG. 9) in other examples.

In this embodiment, upper and lower side edges of the inner hip-lifting piece 30 are both combined with corresponding positions of the second surface layer in a continuous stitching manner, or a fitting or intermittent stitching manner in other examples. Left and right side edges of the inner hip-lifting piece 30 are respectively combined with the outer side seams 101 of the pants body at corresponding sides; the outer side edges 21 of the inner body-shaping piece 20 and the inner hip-lifting piece 30 are connected at the outer side seams 101; and the second shaping portion and the first shaping portion cooperate with each other to constrict the muscles of the inner thighs and lift the muscles of the hips.

Embodiment 5

Figure 10:
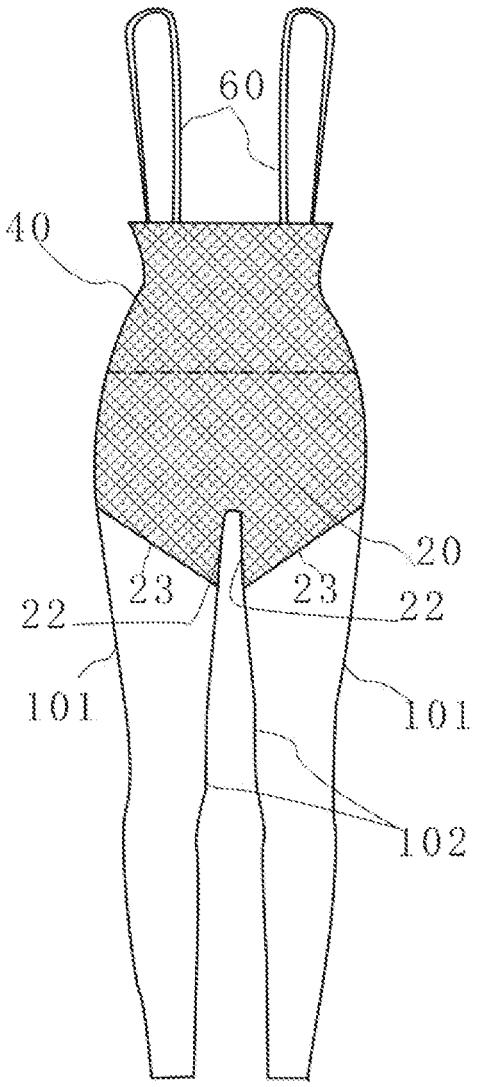
FIG. 10 shows a schematic diagram of a front structure of body-shaping pants in a reversed side according to Embodiment 5 of the present utility model.

As shown in FIG. 10, this embodiment provides thigh-constricting and hip-lifting body-shaping pants, including a pants body of a jumpsuit form, with an unlimited length. The pants body includes a body-shaping surface layer 10, an inner body-shaping piece 20, an inner abdomen-constricting piece 40, and an inner hip-lifting piece 30; the body-shaping surface layer 10, the inner body-shaping piece 20, the inner abdomen-constricting piece 40, and the inner hip-lifting piece 30 are all made of a body-shaping fabric; and the inner body-shaping piece 20, the inner abdomen-constricting piece 40, and the inner hip-lifting piece 30 are all fixedly combined at an inner side of the body-shaping surface layer 10. The body-shaping surface layer is formed into a jumpsuit style by splicing a front pants piece and a back pants piece; the front pants piece and the back pants piece form outer side seams 101 at two sides of a body and inner side seams 102 at inner thighs; and the outer side seams 101 of the upper body portion of the jumpsuit and the outer side seams 101 of the lower body portion of the jumpsuit are connected into a whole.

In this embodiment, the body-shaping surface layer 10 covers a lower body and an upper body below the chest and shoulders, and includes a first surface layer, a second surface layer, and a third surface layer. The first surface layer and the third surface layer are seamlessly woven into a whole; and the second surface layer, the body-shaping surface layer corresponding to the hips, and the body-shaping surface layer corresponding to positions below the shoulders are seamlessly woven into a whole. Here, the first surface layer and the inner shaping piece 20 are correspondingly arranged and jointly form the first shaping portion of a double-layer body-shaping fabric structure, and the first shaping portion is located at a front side of the pants body and correspondingly covers a human upper thigh and pubis region. The second surface layer and the inner hip-lifting piece 30 are correspondingly arranged and jointly form the second shaping portion of a double-layer body-shaping fabric structure, and the second shaping portion is located at a back side of the pants body and arranged corresponding to positions below human hips. The third surface layer and the inner abdomen-constricting piece 40 are correspondingly arranged and jointly form a third shaping portion of a double-layer body-shaping fabric structure, and the third shaping portion is located at the front side of the pants body and correspondingly covers an abdomen region below the human chest. In addition, the jumpsuit in this embodiment further includes two shoulder straps 60, the front ends of which are connected to the upper end of the third surface layer, and the back ends of which are connected to the upper end of the body-shaping surface layer below the shoulders.

The first, second and third shaping portions in this embodiment are the same as the first, second and third shaping portions in Embodiment 4 described above, and will not be repeated here.

The above illustration and description provide the basic principles and main features as well as advantages of the present utility model. Those skilled in the industry should understand that the present utility model is not limited by the embodiments described above. The embodiments described above and the description in the specification are merely for a purpose of explaining the principle of the present utility model. There may be a variety of variations and improvements made to the present utility model without departing from the inventive spirit and scope of the present utility model. These variations and improvements shall fall within the scope Claimed by the present utility model. The scope Claimed by the present utility model are subject to the appended Claims and equivalents thereof

What is claimed is:

1. Thigh-constricting and hip-lifting body-shaping pants, comprising a pants body, wherein the pants body has a second shaping portion on a back side of the pants body and a first shaping portion on a front side of the pants body; the first shaping portion is arranged corresponding to upper thighs and a pubis region and has two inner side edges extending to inner thighs and two outer side edges extending to outer thighs; the second shaping portion is arranged corresponding to positions below hips, and both ends of the second shaping portion and the corresponding outer side edges of the first shaping portion are connected at the outer thighs, respectively; a lowest point of each of the outer side edges of the first shaping portion is higher than a lowest point of each of the inner side edges of the first shaping portion; and the second shaping portion and the first shaping portion cooperate with each other to constrict muscles at the inner thighs and lift muscles of the hips.

2. The thigh-constricting and hip-lifting body-shaping pants according to claim 1, wherein the pants body is a jumpsuit or bottom pants.

3. The thigh-constricting and hip-lifting body-shaping pants according to claim 1, wherein the second shaping portion has a double-layer shaping fabric structure; the second shaping portion consists of a second surface layer of the pants body corresponding to the positions below the hips and an inner hip-lifting piece fixedly combined at an inner side of the second surface layer; the inner hip-lifting piece extends from a crotch of the pants body to the two outer thighs; and upper and lower side edges of the inner hip-lifting piece are both combined with corresponding positions of the second surface layer.

4. The thigh-constricting and hip-lifting body-shaping pants according to claim 1, wherein the second shaping portion and adjacent sides of the pants body are seamlessly woven into a whole; and a stiffness coefficient of the second shaping portion is greater than a stiffness coefficient of an adjacent region.

5. The thigh-constricting and hip-lifting body-shaping pants according to claim 1, wherein the first shaping portion has a double-layer body-shaping fabric structure; the first shaping portion consists of a first surface layer of the pants body corresponding to the upper thighs and the pubis region and an inner shaping piece fixedly combined at an inner side of the first surface layer.

6. The thigh-constricting and hip-lifting body-shaping pants according to claim 5, wherein the pants body has outer side seams and inner side seams; the inner shaping piece is fixedly combined on the first surface layer along the outer side seams and the inner side seams; side boundaries of the inner shaping piece connected to the inner side seams are inner side edges of the inner shaping piece; side boundaries of the inner shaping piece connected to the outer side seams are outer side edges of the inner shaping piece; a lowest point of each of the outer side edges of the inner shaping piece is higher than a lowest point of each of the inner side edges of the inner shaping piece; and the outer side edges of the inner shaping piece and the second shaping portion are connected at the outer side seams.

7. The thigh-constricting and hip-lifting body-shaping pants according to claim 6, wherein a side boundary of the inner shaping piece between the lowest points of the inner side edges of the inner shaping piece and the lowest points of the outer side edges of the inner shaping piece is a hem of the inner shaping piece; the hem of the inner shaping piece is arranged inclinedly; and the hem of the inner shaping piece and the first surface layer are fixedly combined or have a free opening reserved therebetween.

8. The thigh-constricting and hip-lifting body-shaping pants according to claim 5, wherein the inner shaping piece is of a single-piece integral construction or a double-piece parallel construction.

9. The thigh-constricting and hip-lifting body-shaping pants according to claim 5, wherein the pants body further comprises a third shaping portion having a double-layer body-shaping structure; the third shaping portion is arranged corresponding to an abdomen region below a chest; the third shaping portion comprises an inner abdomen-constricting piece connected with the inner shaping piece into a whole; and left and right ends of the inner abdomen-constricting piece are fixedly combined at the outer side seams of the pants body, respectively.

10. The thigh-constricting and hip-lifting body-shaping pants according to claim 1, wherein the pants body further comprises a fourth shaping portion having a double-layer body-shaping fabric structure; the fourth shaping portion is arranged corresponding to back and rear waist regions; the fourth shaping portion comprises a inner back-flattening piece; and left and right ends of the inner back-flattening piece are fixedly combined at the outer side seams of the pants body, respectively.

* * * * *